US005553848A

United States Patent [19]

Amron

[11] Patent Number: 5,553,848

[45] Date of Patent: Sep. 10, 1996

[54] MULTIPLE SPORT PRACTICE APPARATUS

[76] Inventor: Scott L. Amron, 77 Horton Pl., Syosset, N.Y. 11797

[21] Appl. No.: 419,367

[22] Filed: Apr. 10, 1995

[51] Int. Cl.[6] ..... A63B 69/00

[52] U.S. Cl. ..... 273/26 E; 273/29 A; 273/58 C; 273/413

[58] Field of Search ..... 273/413, 26 E, 273/29 A, 58 C

[56] References Cited

U.S. PATENT DOCUMENTS

| | | | |
|---|---|---|---|
| 1,708,796 | 4/1929 | Lawrence | 273/29 A |
| 2,247,072 | 6/1941 | Stow | 273/29 A |
| 2,270,957 | 1/1942 | Mears | 273/29 A |
| 3,341,200 | 9/1967 | Brandley | 273/26 E |
| 3,764,140 | 10/1973 | Lotfy | 273/413 |
| 4,027,880 | 6/1977 | Hadtke | 273/29 A |
| 4,088,316 | 5/1978 | Szaflanski | 273/29 A |
| 4,216,960 | 8/1980 | Nicholls | 273/29 A |
| 4,462,599 | 7/1984 | Brown | 273/413 X |
| 4,576,379 | 3/1986 | Juhasz | 273/413 X |
| 4,679,790 | 7/1987 | Ham | 273/26 E |

*Primary Examiner*—William H. Grieb

[57] ABSTRACT

A portable positioning device which permits a person to engage in the repetitive striking of such object at any selected vertical position, even in a relatively confined location, so as to tone the required muscles, develop muscle memory of the proper motion, and develop the proper execution of the striking motion. The multiple sport practice apparatus includes a portable stand, a generally vertical post or riser portion supported by the stand, an elongated flexible rod assembly at least partially comprised of a flexible material having shape memory, first and second anchoring members for guiding a proximal end portion of the elongated flexible member in rotating movement about a substantially vertical axis defined by the vertical post, and an elastic member for securing a proximal end portion of the elongated flexible member to the vertical post. To the distal end of the elongated flexible member is attached one of a plurality of practice objects such, for example, as a baseball, a soccer ball, a racquet ball, or tennis ball.

10 Claims, 2 Drawing Sheets

MULTIPLE SPORT PRACTICE APPARATUS

BACKGROUND OF THE INVENTION

1. Field of the Invention

The present invention relates generally to recreational games and, more particularly, to a multiple-sport apparatus that finds particular utility in the play of games of the baseball, tennis, racquetball, and soccer type. The apparatus of the present invention is especially suitable for use as a portable practice ball positioning device which enables a person to practice repetitively striking a practice ball located at one of a plurality of vertically preset locations, resulting in a realistic resistance and flight of the struck ball and a quick dampened return of the object to the same location.

2. Discussion of the Prior Art

Recreational games of the tetherball type are numerous. In this type of game, a flexible cord, or tether is connected at one end to a ball and at the other end to the upper end of an upright or vertically disposed pole or standard. The concept of such games, as for example, English tetherball and tether-tennis, is the winding, or wrapping, as a result of a player's striking the ball, of the cord around the pole. Play consists of hitting the ball so that it orbits, while suspended by the cord, in either direction about the standard according to any selected rules.

An example of one of these tetherball games and the apparatus used in its play is that disclosed in U.S. Pat. No. 3,764,140, wherein a spherical hollow ball, such as a tennis ball, is tethered by a flexible, non-resilient cord to a pole or standard disposed in a stationary vertical position, which ball is struck by a paddle wielded by a player so that it orbits about the standard. Typically, the fastening relies on making a hole in the ball and using a peg or piece of wood or the like inside the ball as a stop to which the cord is attached.

Practice ball positioning and return devices are also well known. Muscle memory occurs when a particular motion is repeated a sufficient number of times with accompanying realistic sensations to verify the proper execution of the motion so as to enable a person to precisely reenact the motion when called upon in a competitive setting. In actual competition, the feel of striking the ball, the flight of the ball, and the location of landing of the ball all verify the proper execution of the striking motion. In a game such as tennis, a number of motions are required as a result of the location and speed of the returning tennis ball. Each motion is accompanied by different sensations imparted when striking the ball.

Heretofore, practice ball striking positioning devices have failed to provide portability and to duplicate the normal stroking position of the user or a realistic feel and flight of an object when impacted. The tennis tuner in U.S. Pat. No. 4,027,880 issued to HADTKE on Jun. 7, 1977, for example, provided a ball attached to a combination of horizontal elastic and inelastic cords which necessarily require the striker to straddle one of the cords, thus preventing practice on a high positioned practice ball. Practice devices disclosed in U.S. Pat. No. 4,088,316 to SZAFIANSKI, and in U.S. Pat. No. 2,247,072 to STOW, restrain the struck object along only one axis, in this case the vertical axis. There is a substantial danger that the return flight of the ball will fly directly toward the striker. If the ball is hard, like a baseball, injury can result.

A practicing device described in U.S. Pat. No. 2,270,957 to MEARS is also restrained along a single axis, and although the resistance may be varied by movement of the person, this device does not permit realistic movement of the person during the striking motion or a static resistance to the struck ball. Additionally, this device does not provide the ability to selectively position the ball along the vertical axis for different strokes. Tethered arrangements such as U.S. Pat. No. 4,576,379 to JUHASZ, No. 4,462,599 to BROWN, No. 4,216,960 to NICHOLLS, and No. 1,708,796 to LAWRENCE all merely suspend a ball from a tether.

There is therefore a need for a portable device which permits a person to practice repetitively striking an object located at one of a plurality of vertically preset locations while enjoying realistic resistance, flight, and a quick dampened return of the struck object to the same location.

SUMMARY OF THE INVENTION

According to the present invention, the above identified deficiencies are avoided by a multiple sport apparatus that includes a portable stand, a generally vertical post or riser portion supported by the stand, an elongated flexible member at least partially comprised of a material having shape memory, first and second anchoring members for guiding a proximal end portion of the elongated flexible member in rotating movement about a substantially vertical axis defined by the vertical post, and an elastic member for securing a proximal end portion of the elongated flexible member to the vertical post. To the distal end of the elongated flexible member is attached one of a plurality of practice objects such, for example, as a baseball, a soccer ball, a racquet ball, or tennis ball.

In accordance with an illustrative embodiment of the present invention, the base portion of the stand is configured as a chamber with a substantially planar bottom surface to allow the multiple sport apparatus of the present invention to be supported on a substantially flat underlying outdoor surface such, for example, as a driveway, lawn, or playing field or indoor surface such as a floor, carpet, or the like. A vertically extending shaft extends upwardly from the chamber and defines an opening dimensioned and arranged to receive the lower end of the vertical post. The interior of the chamber may be filled with water, rocks or sand to provide a reliable anchoring arrangement, the interior being sealed by a fill plug. Alternatively, of course, the base portion of the portable stand may be configured as an augur structure engageable with the ground to provide a reliable anchoring arrangement on outdoor lawn or field areas.

In accordance with one aspect of the present invention, the first and second anchoring members are configured as slidable collars which may be positioned at any desired location along the length of the vertical post to respectively define upper and lower limits of movement of the elongated rod as it rotates about the vertical post. The elastic member is secured to the vertical post at one or more locations between the slideable collars and also to a proximal end portion of the elongated flexible member. As will be readily appreciate by those skilled in the art, the collars allow the user to vertically adjust the initial position of the practice object and the elastic member returns the object to the initial position. This arrangement closely approximates the feel and flight of a real baseball, tennis ball, racquetball, or soccer ball. If desired, plural elastic members having respectively different stretch and return properties may be provided so that the user may select a desired degree of dampening over the rate of object movement. Alternatively, provisions may be made to allow the user to add additional elastic members so that the dampening can be incrementally controlled.

A plurality of practice object configurations are contemplated for use in conjunction with the multiple sport apparatus of the present invention. By way of specific example, a baseball practice object constructed in accordance with the present invention may be formed from an actual baseball by defining a bore through the center of the ball. The distal end portion of the flexible member has a reduced diameter or thickness portion which is insertable into and through the bore. The distal tip region of the flexible member is threaded, either on its exterior surface or along an axially extending distal bore so that a threaded fastener may be affixed thereto. The baseball practice object is thus maintained in fixed abutment to an increased thickness portion of the flexible member during use.

As will be readily appreciated by those skilled in the art, soccer- , tennis- and racquet-balls lack a solid core and a different construction is therefore preferred to ensure that the practice object retains the performance characteristics of the genuine ball. Where the practice object is to simulate a soccer ball, for example, an inflatable structure is therefore utilized. To this end, a tube is extended through the center of a conventional soccer ball. The periphery of each end of the tube is sealed with respect to the ball to prevent the leakage of air therefrom. The reduced thickness distal end portion of the flexible member is inserted into the tube and secured in the same manner as described above in connection with the baseball practice object. Other means of securing the distal end region of the flexible member to the practice object may, of course, be utilized. By way of particular example, a threaded bore defined through an exterior surface of the object, may be utilized to retain the threaded distal tip of the flexible member. Since the practice object may be subject to torsional forces during use, however, care should be taken to design suitable safeguards to prevent loosening or separation.

DETAILED DESCRIPTION OF THE INVENTION

The multiple sport, ball practicing arrangement of the present invention is useful in improving one's skill in games which involve the striking of an object such as a soccer ball, baseball, softball, tennis ball, hand ball, racket ball, or shuttlecock with a striking instrument such as a racket, bat stick, or one's foot or hand. The device of the present invention provides a portable positioning device which permits a person to engage in the repetitive striking of such object at any selected vertical position, even in a relatively confined location, so as to tone the required muscles, develop muscle memory of the proper motion, and develop the proper execution of the striking motion.

For illustrative purposes herein the striking instrument will be referred to as a bat and the struck practice object as a ball, both of the type commonly used in the game of baseball or softball, although many variations of the striking and struck object, including those listed above, could be used.

Figure 1:
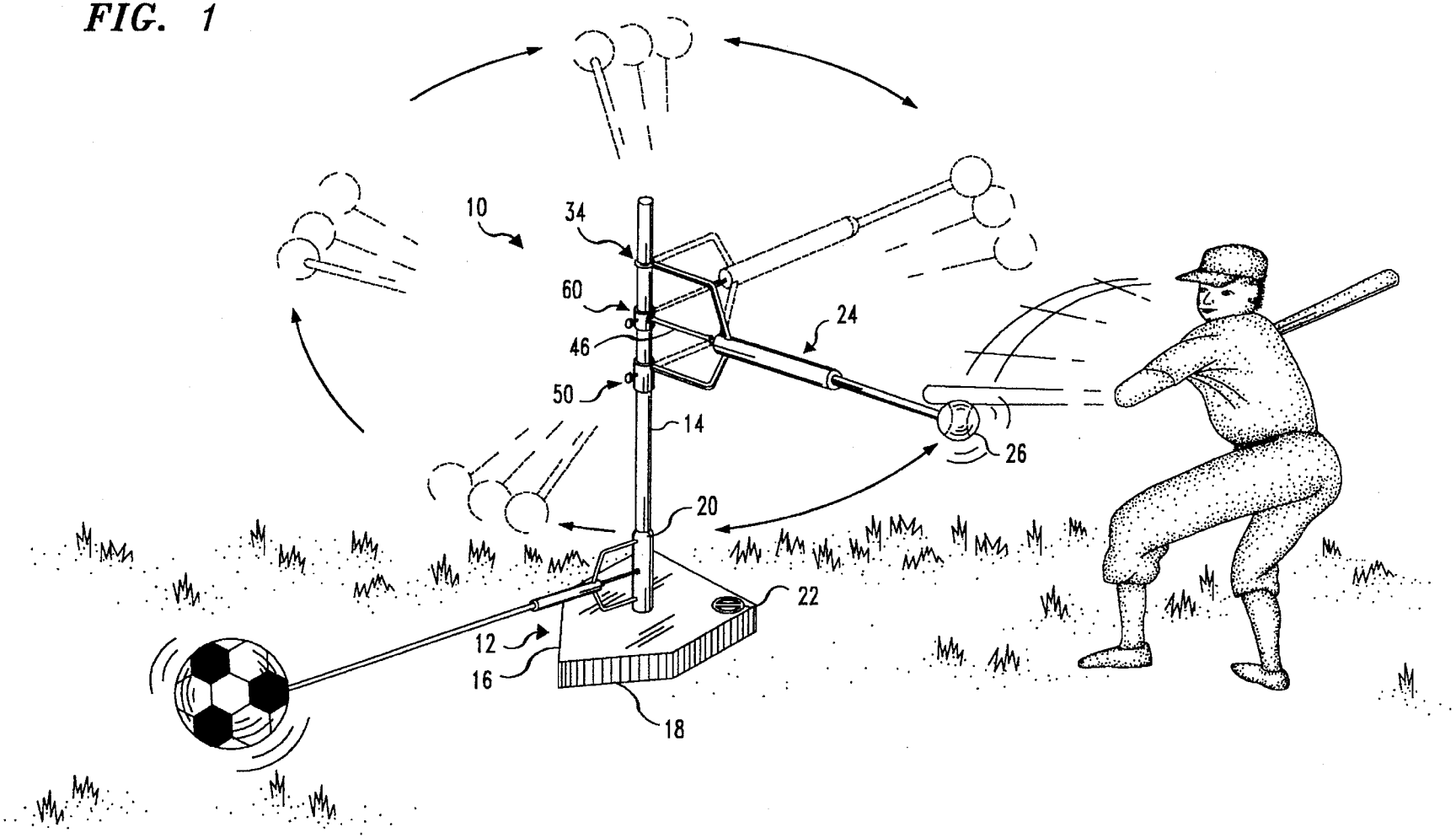
FIG. 1 depicts the apparatus of the present invention being employed in a typical baseball practice session, with the user striking the ball with a baseball bat or the like and orbiting it about a substantially vertical axis.

With reference now to FIG. 1, there is shown a multiple sport practice apparatus 10 constructed in accordance with an illustrative embodiment of the present invention. Apparatus 10 includes a portable stand 12 for supporting a rigid, elongated member such as post 14 in a substantially vertical orientation. In the illustrative embodiment depicted in FIG. 1, portable stand 12 includes a base portion in the form of a chamber 16 with a substantially planar bottom surface 18 to allow the multiple sport apparatus of the present invention to be supported on a substantially flat underlying outdoor surface such, for example, as a driveway, lawn, or playing field or on an indoor surface such as a floor, carpet, or the like. An vertically extending shaft 20 extends upwardly from the chamber and defines an opening dimensioned and arranged to receive the lower end of the vertical post. As will be readily apparent to those skilled in the art, the interior of the chamber 16 may be filled with water, rocks or sand to pro,vide a reliable anchoring arrangement and sealed by fill plug 22. Alternatively, of course, the base portion of the portable stand may be configured as an augur structure (not shown) engageable with the ground to provide a reliable anchoring arrangement on outdoor lawn or field areas.

Figure 2:
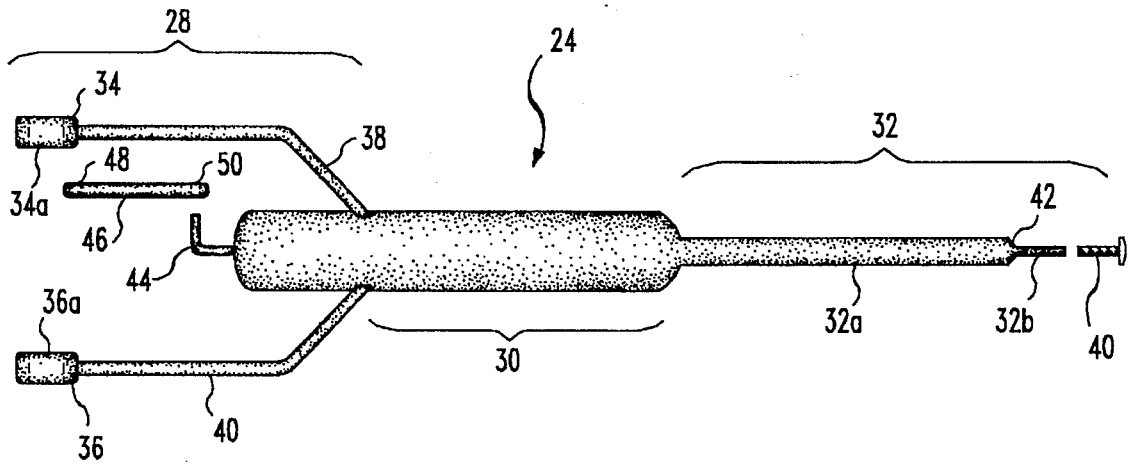
FIG. 2 is a perspective view of the elongated flexible rod member utilized by the embodiment of the present invention depicted in FIG. 1.

In any event, and with continued reference to FIG. 1, it will be seen that apparatus 10 further includes an elongated flexible rod assembly 24 which, at one end, is rotatable about vertical post 14 and, at the other end, accommodates a practice object such as baseball 26. With particular reference to FIG. 2, it will be observed that flexible rod assembly 24 includes a proximal end region 28, an intermediate region 30, and a distal end region 32. Any suitable arrangement may be utilized at the proximal end of assembly 24 to accommodate rotation about post 14. In the embodiment of FIGS. 1 and 2, the assembly 24 is rotatably secured to post 14 by way of a pair of aligned, upper and lower ring elements, 34 and 36, respectively. Thus, each of ring elements 34 and 36 defines a bore or aperture, 34*a*, 36*a* that is dimensioned and arranged to receive the post 14 and permit slidable movement of flexible rod assembly 24 therealong.

Each of ring elements 34 and 36 is retained in aligned relation by an angled bracket member 38, 40 secured to the intermediate region of the assembly. It should be noted that although two ring elements are shown and described, it is also contemplated by the inventor herein that rod assembly 24 may be readily modified to include a single ring element and that alternate configurations of the rod assembly may obviate the need for angled bracket members such as members 38 and 40.

In any event, and with continued reference to FIG. 2, it can be seen that the distal end region 32 of rod assembly 24 includes an increased thickness portion 32*a* and a decreased thickness portion 32*b*. In the embodiment illustrated in FIG. 2, the distal end portion defines an interior threaded bore for accommodating a correspondingly threaded bolt 40 that is dimensioned for insertion through the ball 26 to retain the same against the abutment 42 defined by the interface between portions 32*a* and 32*b*. As indicated above, it is contemplated that balls of various diameters and exterior dimensions may be secured to the flexible rod assembly of the present invention. Accordingly, bolts of different lengths may be provided with apparatus 10 so that a bolt having a length appropriate to the dimensions of the selected ball may be employed. Such a provision would avoid the need to increase the depth of the bore through distal end region 32 and avoid forcing the user to rotate a long screw dimensioned to accommodate a soccer ball many times to reach a length appropriate for a baseball or racquetball. Alternatively, of course, the reduced thickness, distal end region may be configured with a length suitable for ball having the longest bore and an exterior threaded surface to accommodate a threaded retaining nut. Such an arrangement, would require the use of additional retaining nut engageable with the surface portion of the ball facing the post.

To approximate the behavior of a free-traveling object upon impact by a bat or other striking object, at least the distal end region 32 of rod assembly 24 is comprised of a flexible material which returns to its original shape after flexing. By way of illustrative example, a commercially available composite fiberglass material marketed under the trademark Delron, has been found to produce satisfactory results. If desired, the entire rod assembly 24 can be fabricated from the flexible material.

With reference to both FIGS. 1 and 2, it will be seen that the proximal end region of assembly 24 further includes an L-shaped hook member 44 which is dimensioned and arranged for insertion into a bore 50 that extends through elastic member or cord 46 at one end thereof. In a manner which will be described later and as best shown in FIG. 1, elastic member 46 interconnects post 14 and rod assembly 24 so that when the ball 26 is struck, rod assembly 24 rotates about post 14 and the elastic member 46 is stretched and wrapped around the exterior of post 14. At some point, the bias of the stretched elastic member causes the flexible assembly to rotate in the opposite direction, returning the ball toward an initial position to be again struck by the batter.

In accordance with the present invention, an anchoring member 50 is utilized to define the lower limit of travel of the proximal end region of rod assembly 24 relative to post 14. In so doing, anchoring member 50 maintains the initial position of ball 26 at any desired height. In FIG. 1, only a lower anchoring member 50 is shown. It will, of course, be understood that an upper anchoring member (not shown) may also be used to define the upper limit of travel of the rod assembly. Where the ball is to travel in a substantially horizontal plane at the height selected by the position of the lower anchoring member, for example, the lower anchoring member is positioned on post 14 with minimal clearance above ring element 34. If a wider range of planes are desired, the upper anchoring member would be secured to post 14 proximate the upper end thereof to prevent ejection of the flexible rod assembly if elastic member 16 should break.

Figure 3:
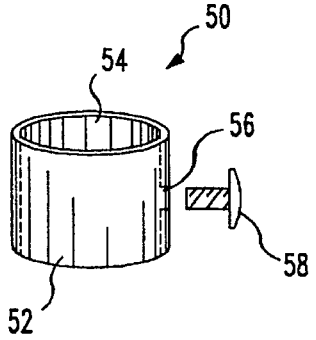
FIG. 3 is an enlarged perspective view of the sliding anchoring member utilized in the embodiment of the present invention depicted in FIG. 1.

In the embodiment of FIGS. 1 and 3, each anchoring member such as anchoring member 50 includes a collar 52 that defines an interior bore 54 and a threaded radial aperture 56 in communication with the bore to accommodate insertion of a set screw 38. The collar construction is preferred since it permits the rod assembly and ball to be rapidly positioned at any desired location along the length of the vertical post. It will, however, be readily ascertained by those skilled in the art that various alternative structures may be employed.

Figure 4:
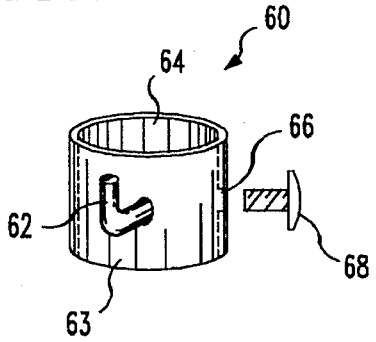
FIG. 4 is an enlarged perspective view of an illustrative anchoring member which may be used to secure one end of the elastic member to the vertical post of the embodiment of the present invention depicted in FIG. 1.

In any event, by reference now to FIGS. 1, 2 and 4, an illustrative assembly for returning the flexible rod assembly 24 into an initial position will best be understood. As best shown in FIG. 2, elongated, elastic member 46 is secured to a hook 62 (FIG. 4) formed on a third anchoring member 60. With particular reference to FIG. 4, third anchoring member 60 comprises a collar 63 having an axial bore 64 and a threaded radial aperture 66 for receiving set screw 68 for adjustable mounting on post 14 in the same manner as described above in connection with the anchoring member 50. As such, the elastic member 46 may be secured to the vertical post at one or more locations between the lower and upper anchoring members and also to a proximal end portion of the elongated flexible member. As will be readily appreciate by those skilled in the art, the collars allow the user to vertically adjust the initial position of the practice object and the elastic member returns the object to the initial position. This arrangement closely approximates the feel and flight of a real baseball, tennis ball, racquetball, or soccerball. If desired, plural elastic members having respectively different stretch and return properties may be provided so that the user may select a desired degree of dampening over the rate of object movement. Alternatively, provisions may be made to allow the user to add additional elastic members so that the dampening can be incrementally controlled.

Figure 5A:
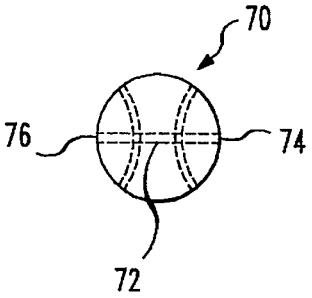
FIG. 5A is a partially broken away view perspective view of an illustrative baseball practice object for use with the apparatus of FIG. 1.

A plurality of practice object configurations are contemplated for use in conjunction with the multiple sport apparatus of the present invention. By way of specific example, a baseball practice object constructed in accordance with the present invention is shown in FIG. 5A. The object 70 may be readily formed from an actual baseball by providing a bore 72 through the center of the ball. As indicated above, the distal end portion of the flexible member has a reduced diameter or thickness portion which is insertable through opening 74 and into the bore 74. A threaded fastener (not shown) is inserted into bore 74 at the other opening 76 and into the threaded bore of the reduced thickness distal end portion 32*a*, as described above.

Figure 5B:
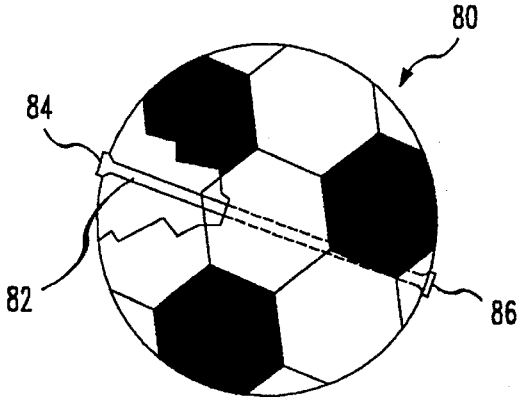
FIG. 5B is a partially broken away perspective view of an illustrative soccer ball practice object for use with the apparatus of FIG. 1.

A soccer ball 80 is shown in FIG. 5B. This structure is conceptually similar to the object shown in FIG. 5A, but has an inflatable interior rather than a solid core. Accordingly, ball 80 includes an elongated tube 82 which extends through openings on each end of the ball. Ring seals 84 and 86 are provided at each end of the ball to prevent the leakage of air along the tube-ball interface. In the same manner as described above, the elongated screw fastener and reduced-thickness portion 32*a* are inserted into opposite openings and threaded into engagement to retain the ball against abutment 42.

In view of the foregoing description, it will be readily appreciated by those skilled in the art that the apparatus of the present invention is configured to permit hitting of a ball from a normal striking position, to simulate realistic resistance and flight of the ball after being struck, and to return the ball quickly to substantially the same location where it was struck. Additionally, the apparatus provides the capability of adjusting the vertical location of the practice ball to permit practice of the basic swings in tennis. The ball may be precisely oriented to minimize undesirable contact between the periphery of the striking instrument and the flexible rod member and to ensure consistent feel and flight of the ball. The apparatus may be self-supported so that the device may be easily moved from location to location without requiring attachment to an adjoining structure or the ground.

Although the invention has been described in terms of a specific embodiment which is set forth in detail, it should be understood that this is for purpose of illustration only and that the invention is not necessarily limited thereto, since alternative embodiments and operating techniques will become apparent to those skilled in the art in view of the disclosure set forth herein. Accordingly, various alterations and modifications are contemplated which can be made without departing from the spirit of the described invention.

What is claimed is:

1. A captive ball apparatus for practice purposes comprising:

an elongated, flexible rod assembly having a proximal end region, a distal end region, and an intermediate region extending therebetween, said proximal region defining at least one opening dimensioned to accommodate a substantially vertical post and to permit rotation therearound:

a practice ball securable to the distal end region of said flexible rod assembly;

a first anchoring member securable to the substantially vertical post to define a lower limit of movement of the proximal end region during rotation of the flexible rod assembly;

a second anchoring member securable to the substantially vertical post; and at least one elastic member for coupling the proximal end region of the rod assembly to the second anchoring member on the substantially vertical post, such that said distal end region and a ball secured thereto is returned to a position for subsequent striking after being initially struck.

2. The apparatus of claim 1, further including a third anchoring member securable to the substantially vertical post to define an upper limit of movement of the proximal end region during rotation of the flexible rod assembly.

3. The apparatus of claim 2, wherein said first and third anchoring members are collars slidably arrangeable on the substantially vertical post, each of said collars defining a threaded bore for receiving a correspondingly threaded set screw.

4. The apparatus of claim 1, further comprising a portable base for supporting the post in a substantially vertical orientation.

5. The apparatus of claim 4, wherein said portable base includes a chamber having an interior cavity dimensioned and arranged to accommodate a fluent material and defines a substantially planar, exterior bottom surface for support on a relatively flat underlying surface.

6. The apparatus of claim 1, wherein the proximal end region of said flexible rod assembly includes at least one ring element for rêceiving the substantially vertical post.

7. The apparatus of claim 1, wherein said flexible rod assembly includes an L-shaped hook member for retaining a first end of said elastic member.

8. The apparatus of claim 7, wherein said second anchoring member is a collar slidably arrangeable on the substantially vertical post, the collar of the second anchoring member defining a threaded bore for receiving a correspondingly threaded set screw and a projection for retaining a second end of said elastic member.

9. The apparatus of claim 1, wherein the distal end region of the flexible rod assembly has a reduced thickness distal portion, the distal tip of the rod assembly having a threaded portion, wherein the practice ball defines a central bore dimensioned and arranged to receive the reduced thickness distal portion and includes a securing member threadedly engageable with the distal tip for retaining the ball in abutment against an increased thickness portion of the distal region.

10. A captive ball apparatus for practice purposes comprising:

a post;

a portable base for supporting said post in a substantially vertical orientation;

an elongated, flexible rod assembly having a proximal end region, a distal end region, and an intermediate region extending therebetween, said proximal end region defining at least one opening dimensioned to accommodate a substantially vertical post and to permit rotational movement therearound;

a practice ball securable to the distal end region of said flexible rod assembly;

first and second anchoring members securable to the substantially vertical post to define upper and lower limits of movement of the proximal end region during rotational movement of the flexible rod assembly;

a third anchoring member securable to the substantially vertical post, said third anchoring member; and at least one elastic member for coupling the proximal end region of the rod assembly to the substantially vertical post, such that said distal end region and a ball secured thereto is returned to an initial position after being struck.

* * * * *